US010549764B2

(12) United States Patent
Hirashima et al.

(10) Patent No.: US 10,549,764 B2
(45) Date of Patent: Feb. 4, 2020

(54) ATTACHING METAL FITTING, ATTACHING UNIT, AND RAILCAR

(71) Applicant: KAWASAKI JUKOGYO KABUSHIKI KAISHA, Kobe-shi, Hyogo (JP)

(72) Inventors: Toshiyuki Hirashima, Kobe (JP); Shirou Honma, Kobe (JP); Mitsuru Yokoyama, Kobe (JP); Shinichiro Hata, Kobe (JP)

(73) Assignee: KAWASAKI JUKOGYO KABUSHIKI KAISHA, Kobe-shi, Hyogo (JP)

( * ) Notice: Subject to any disclaimer, the term of this patent is extended or adjusted under 35 U.S.C. 154(b) by 216 days.

(21) Appl. No.: 15/553,865

(22) PCT Filed: Feb. 27, 2015

(86) PCT No.: PCT/JP2015/001057

§ 371 (c)(1),
(2) Date: Aug. 25, 2017

(87) PCT Pub. No.: WO2016/135782

PCT Pub. Date: Sep. 1, 2016

(65) Prior Publication Data

US 2018/0043908 A1 Feb. 15, 2018

(51) Int. Cl.

| | |
|---|---|
| ***B61F 1/08*** | (2006.01) |
| ***B61C 17/00*** | (2006.01) |
| *B61D 17/10* | (2006.01) |

(52) U.S. Cl.

CPC ..... *B61F 1/08* (2013.01); *B61C 17/00* (2013.01); *B61D 17/10* (2013.01)

(58) Field of Classification Search

CPC ... B61F 1/08; B61F 1/12; B61D 17/10; B61C 17/00

(Continued)

(56) References Cited

U.S. PATENT DOCUMENTS 6,871,903 B2 * 3/2005 Taguchi ..... B61D 17/08 105/396
6,910,428 B2 6/2005 Laflamme et al.

(Continued)

FOREIGN PATENT DOCUMENTS

CN 1572985 A 2/2005
CN 202429204 U 9/2012

(Continued)

OTHER PUBLICATIONS

International Search Report issued in PCT/JP2015/001057; dated May 26, 2015.

(Continued)

*Primary Examiner* — Zachary L Kuhfuss
(74) *Attorney, Agent, or Firm* — Studebaker & Brackett PC

(57) ABSTRACT

An attaching metal fitting is used to attach an underfloor device to an underframe of a railcar including a beam member and includes: a first member located at a lower side of a projecting portion projecting in a horizontal direction at a lower end portion of the beam member and formed integrally with or separately from the beam member; and a second member located at an upper side of the projecting portion, wherein: the first member includes a first supporting portion overlapping the projecting portion from below to be fixed to the projecting portion; the second member includes a second supporting portion overlapping the projecting portion from above to be fixed to the projecting portion; and an upper surface of the second supporting portion supports the underfloor device with the projecting portion sandwiched between the first supporting portion and the second supporting portion.

10 Claims, 7 Drawing Sheets

(58) Field of Classification Search
USPC ..... 105/413
See application file for complete search history.

(56) References Cited

U.S. PATENT DOCUMENTS

| | | | | |
|---|---|---|---|---|
| 9,108,649 | B2 * | 8/2015 | Taguchi | B61D 17/10 |
| 9,180,894 | B2 * | 11/2015 | Taguchi | B61D 17/10 |
| 2004/0231256 | A1 | 11/2004 | Ohnishi | |
| 2015/0020709 | A1 * | 1/2015 | Hayashi | B61F 1/08 105/413 |
| 2018/0037238 | A1 * | 2/2018 | Hirashima | B61D 17/10 |
| 2018/0043907 | A1 * | 2/2018 | Hirashima | B61D 17/10 |

FOREIGN PATENT DOCUMENTS

| | | | | |
|---|---|---|---|---|
| EP | 2 508 407 | A1 | 10/2012 | |
| EP | 3069950 | A4 * | 7/2017 | B61D 17/10 |
| JP | S57-194861 | U1 | 12/1982 | |
| JP | S61-142668 | U | 9/1986 | |
| JP | H01-037332 | Y2 | 11/1989 | |
| JP | H04-041003 | Y2 | 9/1992 | |
| JP | 2004-130914 | A | 4/2004 | |

OTHER PUBLICATIONS

An Office Action issued by Taiwan Patent Office dated Mar. 23, 2016, which corresponds to Taiwanese Patent Application No. 104109880.

An Office Action mailed by the State Intellectual Property Office of the People's Republic of China dated Jul. 23, 2018, which corresponds to Chinese Patent Application No. 201580076843.2 and is related to U.S. Appl. No. 15/553,865.

* cited by examiner

ATTACHING METAL FITTING, ATTACHING UNIT, AND RAILCAR

TECHNICAL FIELD

The present invention relates to an attaching metal fitting and an attaching unit which are used to attach an underfloor device to an underframe of a railcar. The present invention also relates to a railcar including the attaching unit.

BACKGROUND ART

Various underfloor devices are attached to an underframe of a railcar. To attach the underfloor devices, various attaching metal fittings have been used depending on the types of the devices and the types of the railcars. Using such various attaching metal fittings is not preferable in terms of work efficiency and cost. Further, when the underfloor devices are attached to the underframe using fastening members such as bolts, it is desirable to realize such a structure that pulling-direction force for holding the weight of the underfloor devices does not act on the fastening members.

PTL 1proposes such a structure that: a beam member extending in a car longitudinal direction over an entire length of an underframe is newly provided at a car width direction middle of the underframe; and this beam member and side sills support the underfloor devices. According to this configuration, the types of the attaching metal fittings and the number of attaching metal fittings can be reduced, and the pulling-direction force does not act on the fastening members that fix the underfloor devices.

CITATION LIST

Patent Literature

PTL 1: U.S. Pat. No. 6,910,428

SUMMARY OF INVENTION

Technical Problem

However, according to the configuration described in PTL 1, since the beam member extending in the car longitudinal direction over the entire length of the underframe is newly added, there is a problem that the weight of the underframe increases. Especially, according to the configuration described in PTL 1, the number of cross beams is made smaller than that of a typical underframe. In this case, it is necessary to use a floor panel having higher strength than a typical floor panel. On the other hand, when using the typical floor panel, the number of cross beams needs to be larger than that in the configuration described in PTL 1 for the purpose of preventing deflection of the floor panel. In this case, there is a problem that the weight of the underframe including the beam member extending in the car longitudinal direction over the entire length of the underframe increases significantly.

The present invention was made under these circumstances, and an object of the present invention is to provide an attaching metal fitting which is preferable in terms of work efficiency and cost and capable of suppressing an increase in weight of an underframe.

Solution to Problem

An attaching metal fitting according to one aspect of the present invention is an attaching metal fitting used to attach an underfloor device to an underframe of a railcar including a beam member, the attaching metal fitting comprising: a first member located at a lower side of a projecting portion projecting in a horizontal direction at a lower end portion of the beam member and formed integrally with or separately from the beam member; and a second member located at an upper side of the projecting portion, wherein: the first member includes a first supporting portion overlapping the projecting portion from below to be fixed to the projecting portion; the second member includes a second supporting portion overlapping the projecting portion from above to be fixed to the projecting portion; and an upper surface of the second supporting portion supports the underfloor device with the projecting portion sandwiched between the first supporting portion and the second supporting portion.

According to this attaching metal fitting, a fixing position thereof can be set relatively freely. Therefore, the attaching metal fitting can be used for various types of underfloor devices and various types of railcars. Thus, versatility is high. On this account, the attaching metal fitting is preferable in terms of work efficiency and cost. Further, the attaching metal fitting can be arranged in accordance with, for example, the size of the underfloor device. Therefore, it is unnecessary to provide, for example, members that are originally unnecessary for the underframe, and an increase in weight of the underframe can be suppressed.

Advantageous Effects of Invention

As above, the above attaching metal fitting is preferable in terms of the work efficiency and the cost and capable of suppressing the increase in weight of the underframe.

DESCRIPTION OF EMBODIMENTS

Hereinafter, embodiments will be explained in reference to the drawings. In the following explanations and drawings, the same reference signs are used for the same or corresponding components, and a repetition of the same explanation is avoided.

Embodiment 1

Figure 1:
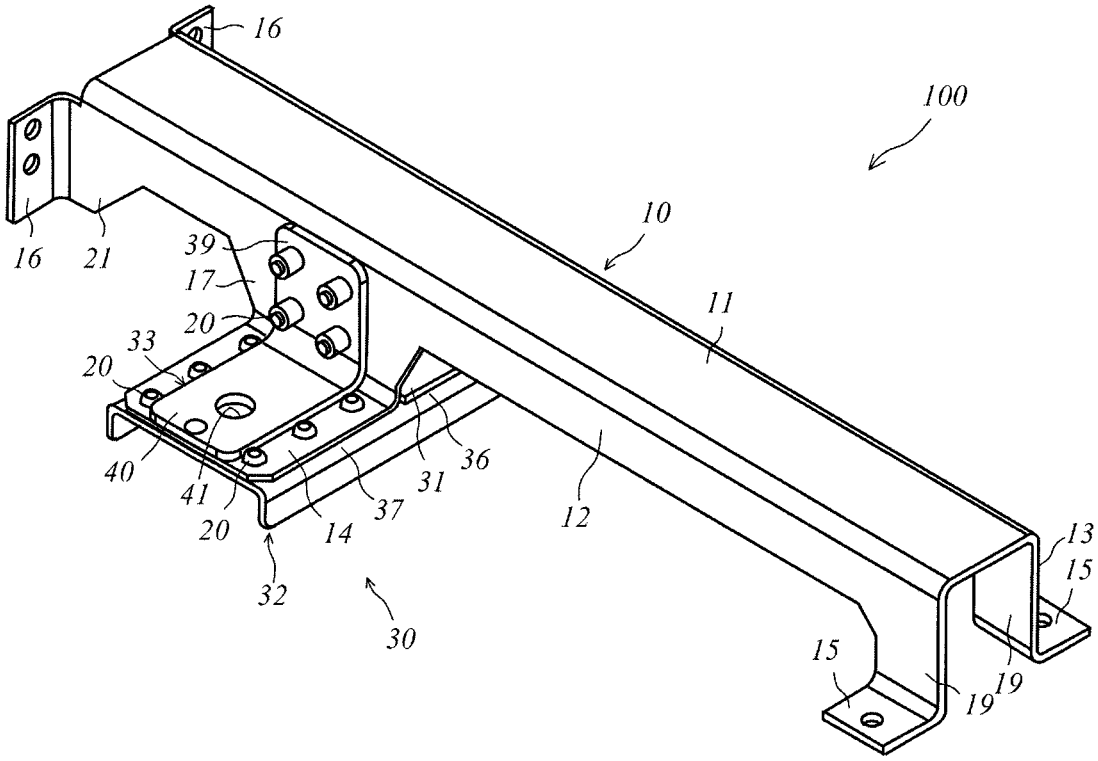
FIG. 1 is a perspective view of an attaching unit according to Embodiment 1.
Figure 2:
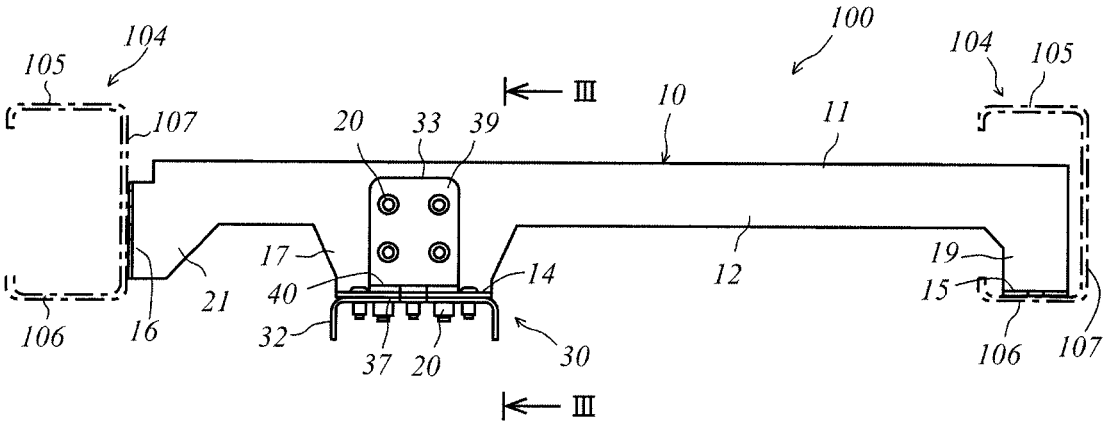
FIG. 2 is a side view of the attaching unit shown in FIG. 1.
Figure 3:
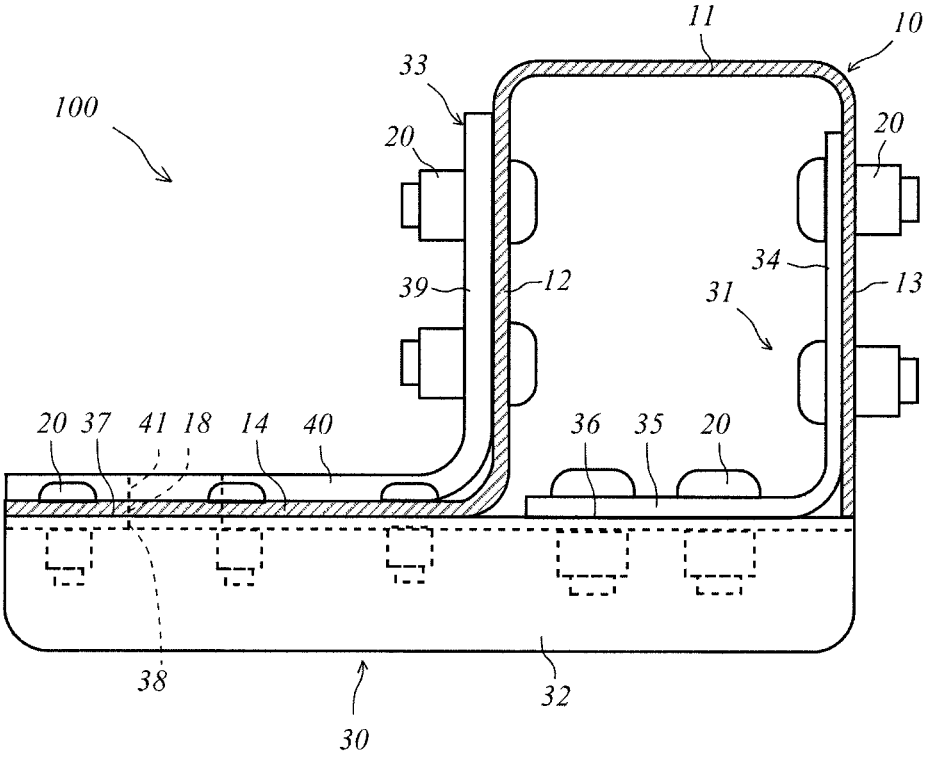
FIG. 3 is a sectional view taken along line of FIG. 2.

First, an attaching unit 100 according to Embodiment 1 will be explained. FIG. 1 is a perspective view of the attaching unit 100. FIG. 2 is a side view of the attaching unit 100. FIG. 3 is a sectional view taken along line of FIG. 2.

In FIG. 2, a paper surface leftward/rightward direction is a car longitudinal direction, and a direction perpendicular to a paper surface is a car width direction. In the following explanations, for convenience sake, in FIG. 2, a paper surface right side is referred to as a "front" side, and a paper surface left side is referred to as a "rear" side.

Figure 4:
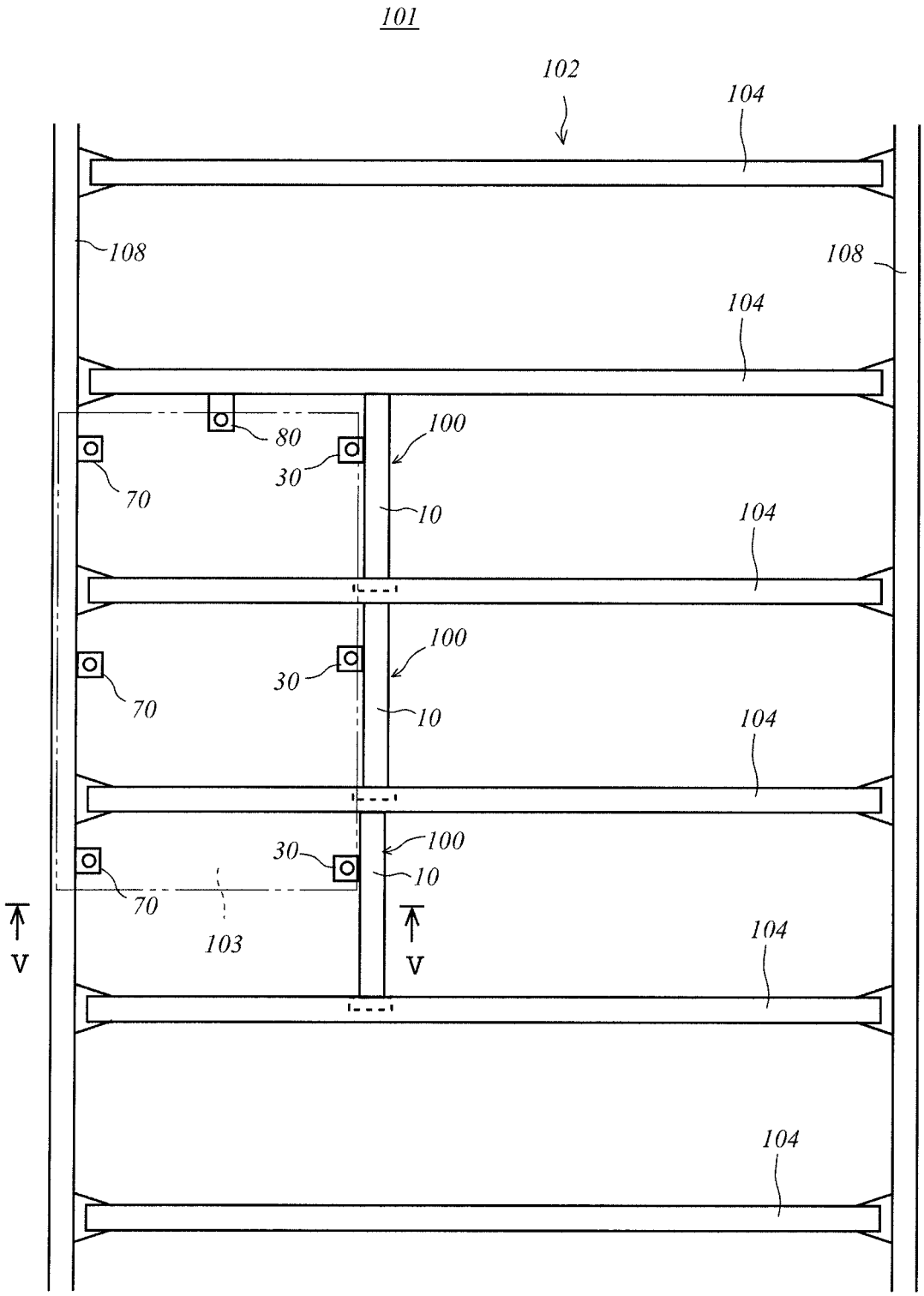
FIG. 4 is a schematic plan view of an underframe.

The attaching unit 100 according to the present embodiment is used to attach an underfloor device 103 to an underframe 102 of a railcar 101. As shown in FIG. 4, the attaching units 100 are provided among a plurality of cross beams 104 so as to correspond to the underfloor device 103 to be arranged. As shown in FIG. 1, the attaching unit 100 includes: an attaching beam member 10 extending between the cross beams 104 (see FIG. 2) arranged at front and rear sides; and an attaching metal fitting 30 fixed to the attaching beam member and supporting the underfloor device 103. Hereinafter, the attaching beam member 10 and the attaching metal fitting 30 will be explained in order.

Attaching Beam Member

The attaching beam member 10 is formed by bending a plate material and includes: an upper plate portion 11 extending in the car longitudinal direction; a first side plate portion 12 and a second side plate portion 13 (see FIG. 3) located at both respective car width direction sides of the upper plate portion 11; a projecting portion 14 projecting in a horizontal direction from a lower end of the first side plate portion 12; first coupling portions 15 provided at a front portion of the attaching member 10; and second coupling portions 16 provided at a rear portion of the attaching member 10.

The first side plate portion 12 includes a trapezoidal extending portion 17 formed such that the size of the extending portion 17 in the car longitudinal direction decreases as the extending portion 17 extends downward. The projecting portion 14 extends in the horizontal direction continuously from a lower end of the extending portion 17. As above, in the present embodiment, the projecting portion 14 is formed integrally with the attaching beam member 10 (first side plate portion 12). As shown in FIG. 3, a fastening hole 18 penetrating the projecting portion 14 in a vertical direction is formed at a middle portion of the projecting portion 14. As shown in FIGS. 1 and 2, the projecting portion 14 is provided at a position shifted from a longitudinal direction middle portion of the attaching beam member 10 toward one end portion of the attaching beam member 10. However, the position of the projecting portion 14 is not limited to the position shown in FIGS. 1 and 2, and the projecting portions 14 may be provided at plural positions.

The first coupling portions 15 are portions coupled to the front-side cross beam 104, and the second coupling portions are portions coupled to the rear-side cross beam 104. As shown in FIG. 2, the cross beam 104 of the present embodiment includes: an upper plate portion 105; a bottom plate portion 106 facing the upper plate portion 105 and located under the upper plate portion 105; and a side plate portion 107 coupling a front end portion of the upper plate portion 105 and a front end portion of the bottom plate portion 106. The cross beam 104 has a C-shaped section that is open rearward.

As shown in FIG. 1, each of the first side plate portion 12 and the second side plate portion 13 includes a leg portion 19 located at the front portion of the attaching beam member 10 and extending downward. The first coupling portion 15 extends outward in the car width direction from a lower end of the leg portion 19 and has a flat plate shape perpendicular to the vertical direction. As shown in FIG. 2, the first coupling portion 15 contacts an upper surface of the bottom plate portion 106 of the front-side cross beam 104 to be fixed to the cross beam 104.

As shown in FIG. 1, each of the first side plate portion 12 and the second side plate portion 13 includes a wide portion 21 located at the rear portion of the attaching beam member 10 and formed such that the size of the wide portion 21 in an upward/downward direction increases as the wide portion 21 extends rearward. The second coupling portion 16 extends outward in the car width direction from a rear end of the wide portion 21 and has a plate shape perpendicular to the car longitudinal direction. As shown in FIG. 2, the second coupling portion 16 contacts an outer surface of the side plate portion 107 of the rear-side cross beam 104 to be fixed to the cross beam 104.

Attaching Metal Fitting

As shown in FIG. 3, the attaching metal fitting 30 according to the present embodiment includes: a first reinforcing member 31 provided at an inner surface side of the attaching beam member 10; a first member 32 located at a lower side of the projecting portion 14; and a second member 33 located at an upper side of the projecting portion 14.

The first reinforcing member 31 is a plate material having an L-shaped section and includes: a vertical plate portion 34 extending in the vertical direction; and a bottom plate portion 35 extending in the horizontal direction from a lower end of the vertical plate portion 34. The first reinforcing member 31 is arranged such that the bottom plate portion 35 is located at a lower portion of the attaching beam member 10 so as to be flush with the projecting portion 14. The vertical plate portion 34 is fixed to an inner surface of the second side plate portion 13 of the attaching beam member 10 using fastening members 20. In the present embodiment, blind fasteners are used as the fastening members 20. However, this is just one example, and rivets, lock bolts, or other fastening members may be used.

As shown in FIG. 1, the first member 32 is a plate material having a C-shaped section that is open downward. The first member 32 includes a first fixing portion 36 and a first supporting portion 37. As shown in FIG. 3, the first fixing portion 36 overlaps the bottom plate portion 35 from below to be fixed to the bottom plate portion 35, and the first supporting portion 37 overlaps the projecting portion 14 from below to be fixed to the projecting portion 14. The first fixing portion 36 and the first supporting portion 37 are fixed using the fastening members 20. Further, a fastening hole 38 penetrating the first supporting portion 37 in the vertical direction is formed at a position corresponding to the fastening hole 18 of the projecting portion 14.

As shown in FIG. 1, the second member 33 is a plate material having an L-shaped section and includes: a second fixing portion 39 extending in the vertical direction; and a second supporting portion 40 extending in the horizontal direction from a lower end of the second fixing portion 39. The second fixing portion 39 overlaps the first side plate portion 12 from a lateral side to be fixed to the first side plate portion 12, and the second supporting portion 40 overlaps the projecting portion 14 from above to be fixed to the projecting portion 14. Specifically, the second supporting portion 40 is fixed to the projecting portion 14 so as to sandwich the projecting portion 14 together with the first supporting portion 37. As shown in FIG. 3, a fastening hole 41 penetrating the second supporting portion 40 in the vertical direction is formed at a position corresponding to the fastening hole 18 of the projecting portion 14.

The attaching metal fittings have been attached by welding or the like. However, as in the present embodiment, the respective parts constituting the attaching metal fitting can be produced by machine work such as pressing and bending. Further, even when assembling the parts to constitute the attaching metal fitting, welding is not required, or the use of the welding can be minimized Therefore, distortion by the welding does not occur, and the assembling can be performed highly accurately.

Method of Using Attaching Unit

Next, the method of using the attaching unit 100 will be explained. FIG. 4 is a schematic plan view of the underframe 102 to which the underfloor device 103 is attached. In FIG. 4, a paper surface upward/downward direction is the car longitudinal direction, a paper surface lower side is a front side, a paper surface upper side is a rear side, and a paper surface leftward/rightward direction is the car width direction. The underframe 102 is a portion corresponding to a floor of a carbody and is formed by some beam members. FIG. 4 shows side sills 108 and the cross beams 104 which are the beam members constituting the underframe 102. The side sills 108 are the beam members located at both respective car width direction ends of the underframe 102 and extending in the car longitudinal direction. Further, the cross beams 104 are the beam members extending in the car width direction and are arranged at predetermined intervals in the car longitudinal direction.

The attaching unit 100 is located between the two cross beams 104, lined up in the car longitudinal direction, to be fixed to the two cross beams. At this time, the attaching unit 100 is arranged at any car width direction position depending on, for example, the size of the underfloor device 103. To provide the attaching unit 100, it is unnecessary to perform complex machining with respect to the cross beam 104. Therefore, the car width direction position of the attaching unit 100 can be easily changed depending on, for example, the size of the underfloor device 103. Further, in the present embodiment, the three attaching units 100 are provided at the underframe 102. However, the number of attaching units 100 provided at the underframe 102 is not especially limited. When providing a plurality of attaching units 100, the car width direction positions of the attaching units 100 may be different from one another.

Figure 5:
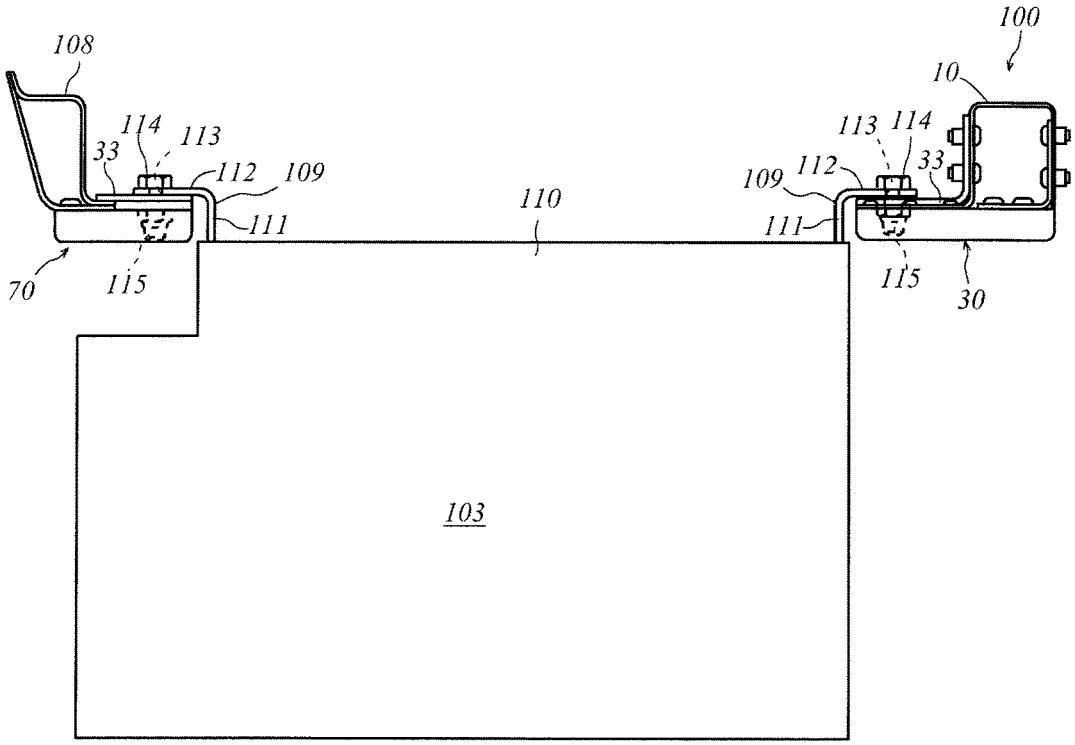
FIG. 5 is a sectional view taken along line V-V of FIG. 4.

FIG. 5 is a sectional view taken along line V-V of FIG. 4. In FIG. 5, a paper surface leftward/rightward direction is the car width direction. As shown in FIG. 5, the underfloor device 103 includes attaching arms 109 at an upper portion thereof. Each of the attaching arms 109 is formed to have an L-shaped section and includes: a vertical portion 111 extending upward from an upper surface of an underfloor device main body 110; and a horizontal portion 112 extending in the horizontal direction from an upper end of the vertical portion 111. A fastening hole 113 is formed at the horizontal portion 112. The attaching arm 109 of the present embodiment is formed to have the L-shaped section but may be formed to have, for example, a Z-shaped section including another horizontal portion 112. The shape of the attaching arm 109 is not limited to these.

When focusing on the attaching arm 109 shown at a paper surface right side in FIG. 5, the horizontal portion 112 of the attaching arm 109 is placed on an upper surface of the second member 33 of the attaching metal fitting 30. In this state, a fastening bolt 114 is inserted into the fastening hole 113 of the attaching arm 109, the fastening hole 41 of the second member 33, the fastening hole 18 of the projecting portion 14, and the fastening hole 38 of the first member 32 in this order from an upper side (see FIG. 3). Then, a fastening nut 115 is fastened to a lower end of the fastening bolt 114. With this, the underfloor device 103 is attached to the underframe 102 of the railcar 101 through the attaching unit 100.

Embodiment 2

Figure 6:
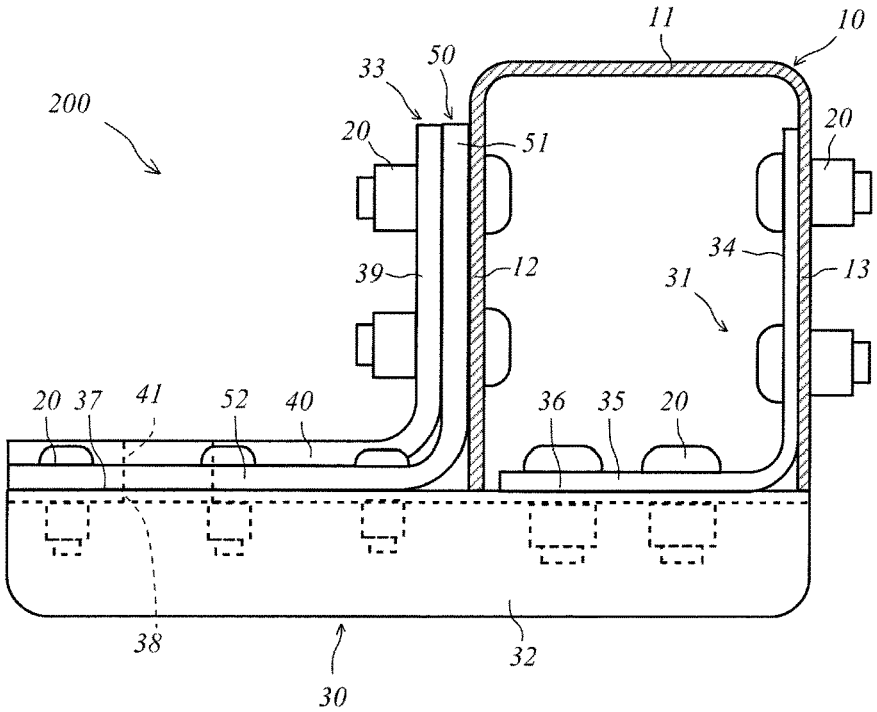
FIG. 6 is a sectional view of the attaching unit according to Embodiment 2.

Next, an attaching unit 200 according to Embodiment 2 will be explained. FIG. 6 is a sectional view of the attaching unit 200 according to the present embodiment and corresponds to FIG. 3 showing Embodiment 1. In the attaching unit 100 according to Embodiment 1, the projecting portion 14 is formed integrally with the attaching beam member 10. However, in the attaching unit 200 according to the present embodiment, a projecting portion 52 is formed separately from the attaching beam member 10. Hereinafter, differences between Embodiment 2 and Embodiment 1 will be mainly explained.

As with the attaching unit 100 according to Embodiment 1, the attaching unit 200 according to the present embodiment includes the attaching beam member 10 and the attaching metal fitting 30. As with the attaching beam member 10 of Embodiment 1, the attaching beam member 10 of the present embodiment includes the upper plate portion 11, the first side plate portion 12, the second side plate portion 13, the first coupling portions 15, and the second coupling portions 16. However, unlike the attaching beam member 10 of Embodiment 1, the attaching beam member 10 of the present embodiment does not include the projecting portion 14. To be specific, the attaching beam member 10 of the present embodiment is the same in configuration as the attaching beam member 10 of Embodiment 1 except that the attaching beam member 10 of the present embodiment does not include the projecting portion 14.

As with the attaching metal fitting 30 of Embodiment 1, the attaching metal fitting 30 of the present embodiment includes the first reinforcing member 31, the first member 32, and the second member 33. The attaching metal fitting 30 of the present embodiment further includes a third member 50 that is not included in the attaching metal fitting 30 of Embodiment 1. The first reinforcing member 31, the first member 32, and the second member 33 in the present embodiment are basically the same in configuration as those in Embodiment 1.

The third member 50 is a plate material having an L-shaped section and includes: a third fixing portion 51 extending in the vertical direction; and the projecting portion 52 extending in the horizontal direction from a lower end of the third fixing portion 51. The third fixing portion 51 is sandwiched between the second fixing portion 39 of the second member 33 and the first side plate portion 12 of the attaching beam member 10 to be fixed to an outer surface of the first side plate portion 12. The projecting portion 52 is sandwiched between the first supporting portion 37 of the first member 32 and the second supporting portion 40 of the second member 33, and these portions are fixed to one another.

If it is difficult to form the projecting portion 14 (see FIG. 1, etc.) integrally with the attaching beam member 10 as in Embodiment 1, the projecting portion 52 may be formed separately from the attaching beam member 10 as in the present embodiment. When the projecting portion 52 is formed separately from the attaching beam member 10 as in the present embodiment, the car longitudinal direction position of the projecting portion 52 can be changed depending on, for example, the size of the underfloor device 103, and therefore, the car longitudinal direction position of the attaching metal fitting 30 can be changed.

Embodiment 3

Figure 7:
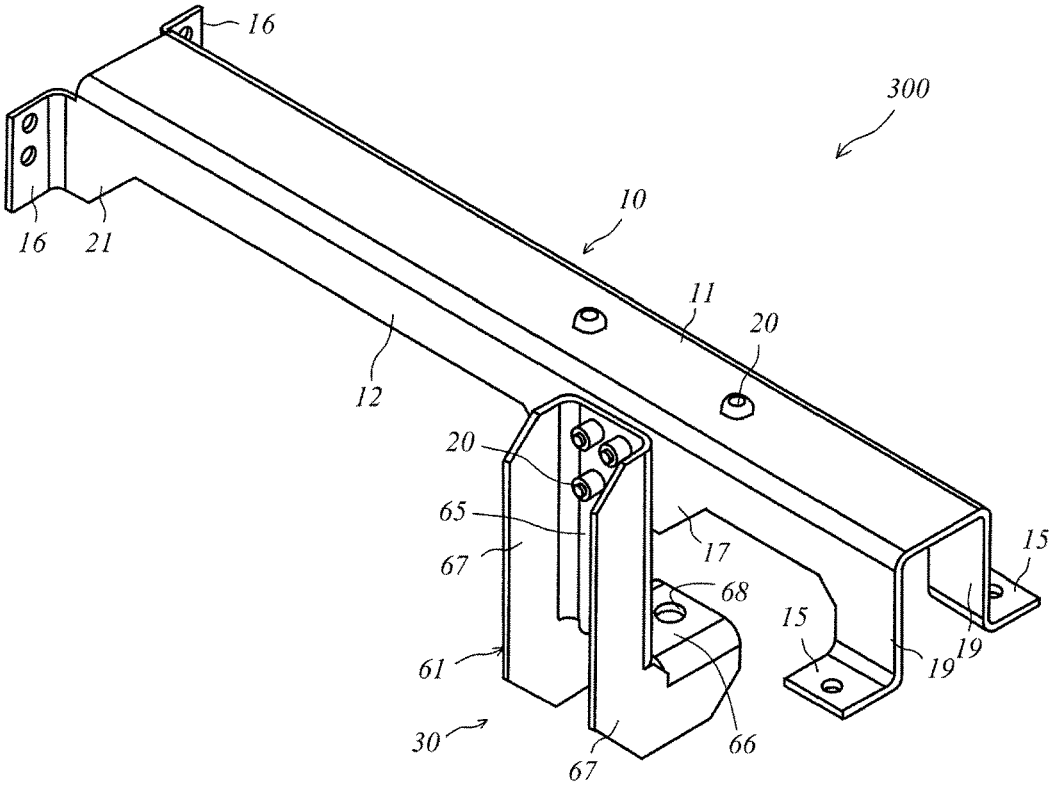
FIG. 7 is a perspective view of the attaching unit according to Embodiment 3.
Figure 8:
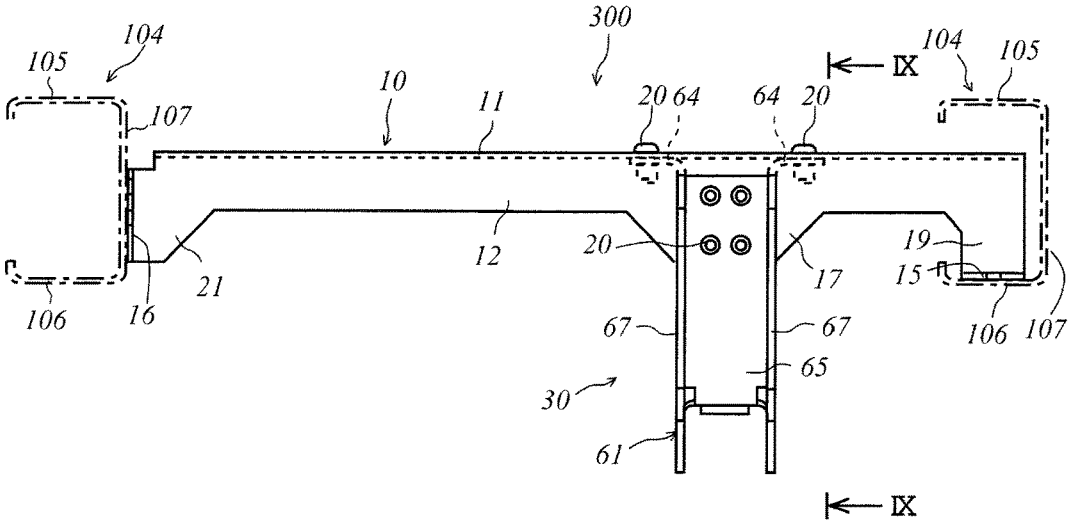
FIG. 8 is a side view of the attaching unit shown in FIG. 7.
Figure 9:
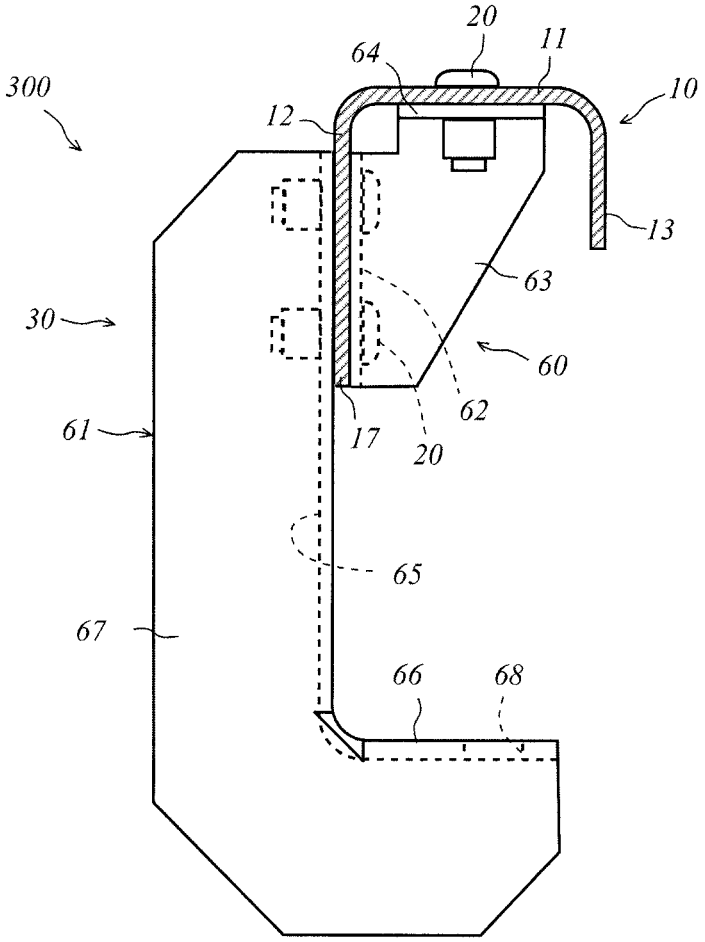
FIG. 9 is a sectional view taken along line IX-IX of FIG. 8.

Next, an attaching unit 300 according to Embodiment 3 will be explained. FIG. 7 is a perspective view of the attaching unit 300. FIG. 8 is a side view of the attaching unit 300. FIG. 9 is a sectional view taken along line IX-IX of FIG. 8. The attaching unit 100 according to Embodiment 1 supports the underfloor device 103 at a car width direction outer side of a main body portion (the upper plate portion 105, the first side plate portion 12, and the second side plate portion 13) of the attaching beam member 10 extending from the front-side cross beam 104 to the rear-side cross beam 104. However, the attaching unit 300 according to the present embodiment supports the underfloor device 103 at a lower side of the main body portion. Hereinafter differences between Embodiment 3 and Embodiment 1 will be mainly explained.

As with the attaching unit 100 according to Embodiment 1, the attaching unit 300 according to the present embodiment includes the attaching beam member 10 and the attaching metal fitting 30. As with Embodiment 1, the attaching beam member 10 according to the present embodiment includes the upper plate portion 11, the first side plate portion 12, the second side plate portion 13, the first coupling portions 15, and the second coupling portions 16. However, the attaching beam member 10 according to the present embodiment does not include the projecting portion 14 (see FIG. 1, etc.) that is included in the attaching beam member 10 of Embodiment 1. Further, as shown in FIG. 9, the first side plate portion 12 includes the extending portion 17, but the second side plate portion 13 does not include the extending portion 17.

The attaching metal fitting 30 of the present embodiment is different in shape from the attaching metal fitting 30 of Embodiment 1. As shown in FIG. 9, the attaching metal fitting 30 of the present embodiment includes: a second reinforcing member 60 located at an inner side of the attaching beam member 10; and a fourth member 61 for supporting the underfloor device 103. The second reinforcing member 60 is formed by a plate material and includes: a vertical plate portion 62 extending in the vertical direction and fixed to an inner surface of the first side plate portion 12 of the attaching beam member 10; two side plate portions 63 located at both respective car longitudinal direction sides of the vertical plate portion 62 and perpendicular to the car longitudinal direction; and two horizontal plate portions 64 each extending outward in the car longitudinal direction from an upper end of the side plate portion 63 to be fixed to an inner surface of the upper plate portion 11 of the attaching beam member 10 (also see FIG. 8).

The fourth member 61 includes: a fourth fixing portion 65 extending in the vertical direction and including an upper portion overlapping an outer surface of the first side plate portion 12 of the attaching beam member 10 from a lateral side to be fixed to the outer surface; a fourth supporting portion 66 extending in the horizontal direction from a lower end of the fourth fixing portion 65 to be located under the attaching beam member 10; and L-shaped side plate portions 67 located at both respective car longitudinal direction sides of each of the fourth fixing portion 65 and the fourth supporting portion 66. A through hole 68 penetrating the fourth supporting portion 66 in the vertical direction is formed at a middle portion of the fourth supporting portion 66. In the present embodiment, the underfloor device 103 is placed on an upper surface of the fourth supporting portion 66. In this state, the underfloor device 103 is fixed to the fourth supporting portion 66 using the fastening bolt 114 and the fastening nut 115.

Modified Examples

In the attaching units 100, 200, and 300 according to Embodiments 1 to 3, the main body portion of the attaching beam member 10 has a C-shaped section that is open downward. However, the shape of the attaching beam member 10 is not limited to such shape. For example, the attaching beam member 10 may have a C-shaped section that is open upward or toward a lateral side or may have a rectangular frame-shaped section not including an opening portion. In these cases, in Embodiments 1 and 2, the bottom plate portion 35 to which the first member 32 is fixed is included in (is formed integrally with) the attaching beam member 10, so that the first reinforcing member 31 can be omitted.

Further, in Embodiments 1 and 2, the second member 33 may be subjected to the pressing such that the middle portion thereof is convex in a thickness direction. In this case, the strength of the second member 33 improves, so that in Embodiment 1, the projecting portion 14 of the attaching beam member 10 can be omitted, and in Embodiment 2, the third member 50 can be omitted. Similarly, when the projecting portion 14 in Embodiment 1 is subjected to the pressing such that the middle portion thereof is convex in the thickness direction, or when the projecting portion 52 in Embodiment 2 is subjected to the pressing such that the middle portion thereof is convex in the thickness direction, the second member 33 can be omitted.

Embodiment 4

Figure 10:
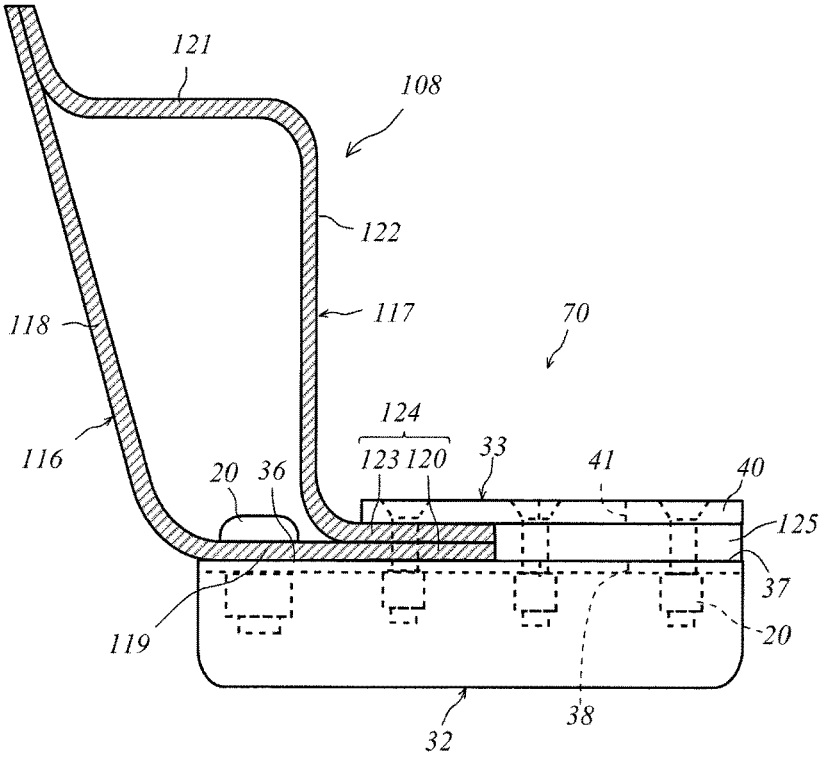
FIG. 10 is a side view of an attaching metal fitting according to Embodiment 4.

Next, an attaching metal fitting 70 according to Embodiment 4 will be explained. FIG. 10 is a side view of the attaching metal fitting 70 according to the present embodiment. In FIG. 10, a paper surface leftward/rightward direction is the car width direction, and a direction perpendicular to a paper surface is the car longitudinal direction. The attaching metal fitting 30 according to Embodiments 1 to 3 is fixed to the attaching beam member 10, whereas the attaching metal fitting 70 according to the present embodiment is fixed to the side sill 108.

The side sill 108 of the present embodiment is formed by connecting a lower beam member 116 having an L-shaped section and an upper beam member 117 having a substantially S-shaped section. As a whole, the side sill 108 of the present embodiment is a beam member having a rectangular frame-shaped section. The lower beam member 116 includes: an outer side plate portion 118 located at a car width direction end portion side (hereinafter referred to as a "car width direction outer side") of the underframe 102; a bottom plate portion 119 extending from a lower end of the outer side plate portion 118 toward a car width direction middle side (hereinafter referred to as a "car width direction inner side") of the underframe 102; and a lower beam projecting portion 120 located at the car width direction inner side of the bottom plate portion 119. The upper beam member 117 includes: an upper plate portion 121 facing the bottom plate portion 119; an inner side plate portion 122 extending downward from a car width direction inner side end of the upper plate portion 121; and an upper beam projecting portion 123 extending from a lower end of the inner side plate portion 122 toward the car width direction inner side to contact the lower beam projecting portion 120. It should be noted that the lower beam projecting portion 120 and the upper beam projecting portion 123 constitute a projecting portion 124.

The attaching metal fitting 70 according to the present embodiment includes the first member 32 and the second member 33. The first member 32 is formed so as to be the same as the first member 32 of Embodiments 1 to 3 and includes: the first fixing portion 36 overlapping the bottom plate portion 119 of the side sill 108 from below to be fixed to the bottom plate portion 119; and the first supporting portion 37 located at a lower side of the projecting portion 124 of the side sill 108. The first supporting portion 37 of the present embodiment is larger in size in the car width direction than the projecting portion 124, and a tip end portion thereof is located at the car width direction inner side of the projecting portion 124. The fastening hole 38 penetrating the first supporting portion 37 in the vertical direction is formed at a middle portion of the first supporting portion 37.

On the other hand, unlike the second member 33 of Embodiments 1 to 3, the second member 33 is not formed to have an L-shaped section. As a whole, the second member 33 is formed to have a flat plate shape. To be specific, the second member 33 of the present embodiment includes the second supporting portion 40 but does not include the second fixing portion 39 (see FIG. 1, etc.). The second supporting portion 40 is located at an upper side of the projecting portion 124 of the side sill 108. As with the first supporting portion 37, the second supporting portion 40 is larger in size in the car width direction than the projecting portion 124, and a tip end portion thereof is located at the car width direction inner side of the projecting portion 124. The second supporting portion 40 overlaps the projecting portion 124 from above and is fixed to the projecting portion 124 so as to sandwich the projecting portion 124 together with the first supporting portion 37. The fastening hole 41 is formed at a position of a middle portion of the second supporting portion 40, the position corresponding to the fastening hole 38 of the first supporting portion 37.

A spacer 125 having the same thickness as the projecting portion 124 is inserted between the tip end portion of the first supporting portion 37 and the tip end portion of the second supporting portion 40. The spacer 125 may be arranged so as to avoid the fastening holes 38 and 41 for the purpose of preventing interference with the below-described fastening bolt 114, or the spacer 125 may have through holes formed at positions corresponding to the fastening holes 38 and 41. The spacer 125 is inserted between the tip end portion of the first supporting portion 37 and the tip end portion of the second supporting portion 40, so that even when the fastening bolt 114 is fastened, a distance between the first supporting portion 37 and the second supporting portion 40 is kept constant, and the first member 32 and the second member 33 can be prevented from being distorted.

FIG. 5 described above also shows a method of attaching the underfloor device 103 using the attaching metal fitting 70. As shown at a paper surface upper left side in FIG. 5, the horizontal portion 112 of the attaching arm 109 is placed on the upper surface of the second member 33 of the attaching metal fitting 70. In this state, the fastening bolt 114 is inserted into the fastening hole 113 of the attaching arm 109, the fastening hole 41 of the second member 33, and the fastening hole 38 of the first member 32 in this order from an upper side (see FIG. 10). Then, the fastening nut 115 is fastened to the lower end of the fastening bolt 114. With this, the underfloor device 103 is attached to the underframe 102 of the railcar 101 through the attaching metal fitting 70.

As above, according to the attaching metal fitting 70 of the present embodiment, when fixing the attaching metal fitting 70 to the side sill 108, it is unnecessary to perform complex machining with respect to the side sill 108. Therefore, the car longitudinal direction position of the attaching metal fitting 70 can be easily changed depending on, for example, the size of the underfloor device 103 (see FIG. 4).

Embodiment 5

Figure 11:
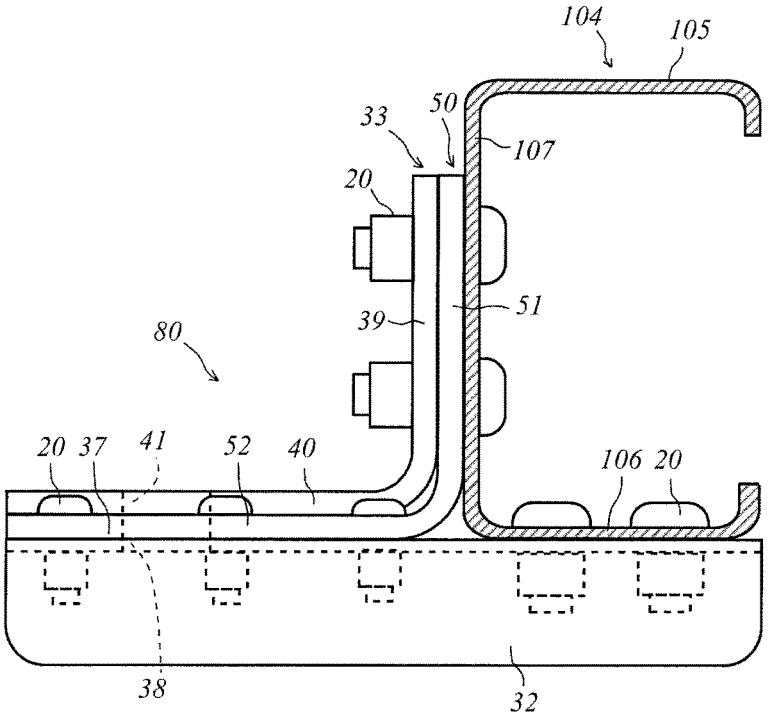
FIG. 11 is a side view of the attaching metal fitting according to Embodiment 5.

Next, an attaching metal fitting 80 according to Embodiment 5 will be explained. FIG. 11 is a side view of the attaching metal fitting 80 according to the present embodiment. In FIG. 11, a paper surface leftward/rightward direction is the car longitudinal direction, a direction perpendicular to a paper surface is the car width direction, a paper surface left side is a front side, and a paper surface right side is a rear side. The attaching metal fitting 70 according to the present embodiment is fixed to the cross beam 104. As described above, the cross beam 104 includes the upper plate portion 105, the bottom plate portion 106, and the side plate portion 107 and is formed to have a C-shaped section that is open rearward.

The attaching metal fitting 80 according to the present embodiment is basically the same in structure as the attaching metal fitting 30 according to Embodiment 2 except that the attaching metal fitting 80 is fixed to the cross beam 104. Specifically, the attaching metal fitting 80 according to the present embodiment includes the first member 32, the second member 33, and the third member 50. The first fixing portion 36 of the first member 32 overlaps the bottom plate portion 106 from below to be fixed to the bottom plate portion 106 of the cross beam 104. The third fixing portion 51 of the third member 50 and the second fixing portion 39 of the second member 33 overlap the side plate portion 107 from a lateral side to be fixed to the side plate portion 107 of the cross beam 104. The second supporting portion 40 is fixed to the projecting portion 52 so as to sandwich the projecting portion 52 together with the first supporting portion 37, and an upper surface thereof supports the underfloor device 103.

Effects, etc

As above, the attaching metal fitting according to each of Embodiments 1 to 5 is an attaching metal fitting used to attach an underfloor device to an underframe of a railcar including a beam member, the attaching metal fitting including: a first member located at a lower side of a projecting portion projecting in a horizontal direction at a lower end portion of the beam member and formed integrally with or separately from the beam member; and a second member located at an upper side of the projecting portion, wherein: the first member includes a first supporting portion overlapping the projecting portion from below to be fixed to the projecting portion; the second member includes a second supporting portion overlapping the projecting portion from above to be fixed to the projecting portion; and an upper surface of the second supporting portion supports the underfloor device with the projecting portion sandwiched between the first supporting portion and the second supporting portion.

According to the above configuration, a fixing position thereof can be set relatively freely. Therefore, the attaching metal fitting can be used for various types of underfloor devices and various types of railcars. Thus, versatility is high. On this account, the attaching metal fitting is preferable in terms of work efficiency and cost. Further, the attaching metal fitting can be arranged in accordance with, for example, the size of the underfloor device. Therefore, it is unnecessary to provide, for example, members that are originally unnecessary for the underframe, and an increase in weight of the underframe can be suppressed.

In the attaching metal fitting according to each of Embodiments 1, 2, 4, and 5, the first member includes a first fixing portion in addition to the first supporting portion, and the first fixing portion overlaps a bottom plate portion from below to be fixed to the bottom plate portion, the bottom plate portion being located at a lower portion of the beam member so as to be flush with the projecting portion and being formed integrally with or separately from the beam member.

As above, by fixing the first fixing portion of the first member to the bottom plate portion, a part of load applied from the underfloor device can be supported by the first fixing portion. With this, it is possible to prevent a case where when the underfloor device is attached, a base end portion of the projecting portion deforms, and therefore, the underfloor device inclines.

In the attaching metal fitting according to each of Embodiments 1, 2, and 5, the second member includes a second fixing portion in addition to the second supporting portion, and the second fixing portion overlaps a side plate portion of the beam member from a lateral side to be fixed to the side plate portion, the side plate portion being located at an upper side of the projecting portion.

As above, by fixing the second fixing portion of the second member to the side plate portion of the beam member, a part of the load applied from the underfloor device can be supported by the second fixing portion. Therefore, it is possible to prevent a case where when the underfloor device is attached, the base end portion of the projecting portion deforms, and therefore, the underfloor device inclines.

The attaching metal fitting according to each of Embodiments 2 and 5 further includes a third member formed separately from the first member and including the projecting portion, wherein: the third member includes a third fixing portion extending upward in a vertical direction from the projecting portion and is formed to have an L-shaped section; the third fixing portion is fixed to a side plate portion of the beam member; and the second supporting portion, the projecting portion, and the first supporting portion overlap one another in this order from an upper side to be integrally fixed to one another.

As above, when the projecting portion is formed separately from the beam member, the third member including the projecting portion is formed to have an L-shaped section. With this, it is possible to prevent a case where when the underfloor device is placed at an upper side of the projecting portion, the base end portion of the projecting portion deforms. Therefore, it is possible to prevent the underfloor device from inclining.

The attaching unit according to each of Embodiments 1 and 2 is an attaching unit provided between at least two cross beams extending in a car width direction, an underfloor device being attachable to the attaching unit through an attaching metal fitting, the attaching unit including: an attaching beam member arranged between the two cross beams and extending in a car longitudinal direction; and the attaching metal fitting fixed to the attaching beam member and used to attach the underfloor device to an underframe of a railcar, wherein: the attaching metal fitting includes a first member located at a lower side of a projecting portion projecting in a horizontal direction at a lower end portion of the attaching beam member and formed integrally with or separately from the attaching beam member, and a second member located at an upper side of the projecting portion; the first member includes a first supporting portion overlapping the projecting portion from below to be fixed to the projecting portion; the second member includes a second supporting portion overlapping the projecting portion from above to be fixed to the projecting portion; an upper surface of the second supporting portion supports the underfloor device with the projecting portion sandwiched between the first supporting portion and the second supporting portion; and the attaching beam member is configured to be provided at any car width direction position between the two cross beams.

As above, when the beam member (attaching beam member) to which the attaching metal fitting is fixed can be arranged at any car width direction position between two cross beams, the attaching metal fitting can be arranged at any position in the car width direction. Therefore, the degree of freedom of design regarding the arrangement of the underfloor device can be improved.

In the attaching unit according to each of Embodiments 1 to 3, the attaching beam member is provided between the two cross beams each including an upper plate portion, a bottom plate portion, and a side plate portion coupling one end portion of the upper plate portion and one end portion of the bottom plate portion, the one end portions being located at one car longitudinal direction side, the two cross beams each formed to have a C-shaped section that is open toward the other car longitudinal direction side, and the attaching beam member includes a first coupling portion coupled to an upper surface of the bottom plate portion of one out of the two cross beams and a second coupling portion coupled to an outer surface of the side plate portion of the other cross beam.

As above, the first and second coupling portions for coupling the attaching beam member to the cross beams are different in structure from each other. With this, even when load is applied from various directions, the attaching beam member can be prevented from falling off. Especially, the first coupling portion is coupled to the upper surface of the bottom plate portion of the cross beam. Therefore, even if the fastening member coupling the first coupling portion and the cross beam breaks, the attaching beam member can be prevented from falling off.

The attaching unit according to Embodiment 3 is an attaching unit provided between at least two cross beams extending in a car width direction, an underfloor device being attachable to the attaching unit through an attaching metal fitting, the attaching unit including: an attaching beam member arranged between the two cross beams and extending in a car longitudinal direction; and the attaching metal fitting fixed to the attaching beam member and used to attach the underfloor device to an underframe of a railcar, wherein: the attaching beam member is configured to be provided at any car width direction position between the two cross beams; and the attaching metal fitting includes a fourth fixing portion overlapping the attaching beam member from a lateral side to be fixed to the attaching beam member and extending downward from the attaching beam member and a fourth supporting portion extending in a horizontal direction from a lower end portion of the fourth fixing portion to be located under the attaching beam member.

As above, in Embodiment 3, the underfloor device can be supported under the beam member, unlike the other embodiments. By using the above attaching unit, the degree of freedom of design regarding the arrangement of the underfloor device can be further improved. For example, when the attaching unit according to each of Embodiments 1 and 2 interferes with a member other than the underfloor device, such interference can be avoided by using the attaching unit according to Embodiment 3.

The railcar according to each of Embodiments 1 to 5 includes the above-described attaching unit and an underfloor device supported by the attaching unit. Therefore, the railcar according to each of Embodiments 1 to 5 can obtain the above-described effects.

In the railcar according to each of Embodiments 1 to 5, the underfloor device includes an attaching arm including a horizontal portion, and the horizontal portion is fixed to an upper surface of the attaching metal fitting. With this, the load of the underfloor device is applied to the upper surfaces of the attaching metal fittings, and pulling-direction load is not applied to the fastening bolts. Therefore, the fastening bolts hardly break. Further, even if the fastening bolts break or the fastening nuts are loosened to fall off, the underfloor device is supported by the attaching metal fittings and does not fall off immediately.

REFERENCE SIGNS LIST

10 attaching beam member (beam member)
12 first side plate portion (side plate portion)
14 projecting portion
15 first coupling portion
16 second coupling portion
30 attaching metal fitting
32 first member
33 second member
35 bottom plate portion
36 first fixing portion
37 first supporting portion
39 second fixing portion
40 second supporting portion
50 third member
51 third fixing portion
52 projecting portion
61 fourth member
65 fourth fixing portion
66 fourth supporting portion
70 attaching metal fitting
80 attaching metal fitting
100 attaching unit
101 railcar
102 underframe
103 underfloor device
104 cross beam (beam member)
106 bottom plate portion
107 side plate portion
108 side sill (beam member)
109 attaching arm
119 bottom plate portion
124 projecting portion
200 attaching unit
300 attaching unit

The invention claimed is:

1. An attaching metal fitting used to attach an underfloor device to an underframe of a railcar including a beam member, the attaching metal fitting comprising:

a first member located at a lower side of a projecting portion projecting in a horizontal direction at a lower end portion of the beam member and formed integrally with or separately from the beam member; and a second member located at an upper side of the projecting portion, wherein:

the first member includes a first supporting portion overlapping the projecting portion from below to be fixed to the projecting portion;

the second member includes a second supporting portion overlapping the projecting portion from above to be fixed to the projecting portion; and an upper surface of the second supporting portion supports the underfloor device with the projecting portion sandwiched between the first supporting portion and the second supporting portion, wherein:

the first member includes a first fixing portion in addition to the first supporting portion; and the first fixing portion overlaps a bottom plate portion from below to be fixed to the bottom plate portion, the bottom plate portion being located at a lower portion of the beam member so as to be flush with the projecting portion and being formed integrally with or separately from the beam member.

2. An attaching metal fitting used to attach an underfloor device to an underframe of a railcar including a beam member, the attaching metal fitting comprising:

a first member located at a lower side of a projecting portion projecting in a horizontal direction at a lower end portion of the beam member and formed integrally with or separately from the beam member; and a second member located at an upper side of the projecting portion, wherein:

the first member includes a first supporting portion overlapping the projecting portion from below to be fixed to the projecting portion;

the second member includes a second supporting portion overlapping the projecting portion from above to be fixed to the projecting portion; and an upper surface of the second supporting portion supports the underfloor device with the projecting portion sandwiched between the first supporting portion and the second supporting portion, wherein:

the second member includes a second fixing portion in addition to the second supporting portion; and the second fixing portion overlaps a side plate portion of the beam member from a lateral side to be fixed to the side plate portion, the side plate portion being located at an upper side of the projecting portion.

3. An attaching metal fitting used to attach an underfloor device to an underframe of a railcar including a beam member, the attaching metal fitting comprising:

a first member located at a lower side of a projecting portion projecting in a horizontal direction at a lower end portion of the beam member and formed integrally with or separately from the beam member;

a second member located at an upper side of the projecting portion, and a third member formed separately from the first member and including the projecting portion, wherein:

the first member includes a first supporting portion overlapping the projecting portion from below to be fixed to the projecting portion;

the second member includes a second supporting portion overlapping the projecting portion from above to be fixed to the projecting portion;

an upper surface of the second supporting portion supports the underfloor device with the projecting portion sandwiched between the first supporting portion and the second supporting portion;

the third member includes a third fixing portion extending upward in a vertical direction from the projecting portion and is formed to have an L-shaped section;

the third fixing portion is fixed to a side plate portion of the beam member; and the second supporting portion, the projecting portion, and the first supporting portion overlap one another in this order from an upper side to be integrally fixed to one another.

4. An attaching unit provided between at least two cross beams extending in a car width direction, an underfloor device being attachable to the attaching unit through an attaching metal fitting, the attaching unit comprising:

an attaching beam member arranged between the two cross beams and extending in a car longitudinal direction; and the attaching metal fitting fixed to the attaching beam member and used to attach the underfloor device to an underframe of a railcar, wherein:

the attaching metal fitting includes a first member located at a lower side of a projecting portion projecting in a horizontal direction at a lower end portion of the attaching beam member and formed integrally with or separately from the attaching beam member, and a second member located at an upper side of the projecting portion;

the first member includes a first supporting portion overlapping the projecting portion from below to be fixed to the projecting portion;

the second member includes a second supporting portion overlapping the projecting portion from above to be fixed to the projecting portion;

an upper surface of the second supporting portion supports the underfloor device with the projecting portion sandwiched between the first supporting portion and the second supporting portion; and the attaching beam member is configured to be provided at any car width direction position between the two cross beams.

5. The attaching unit according to claim 4, wherein:

the attaching beam member is provided between the two cross beams each including an upper plate portion, a bottom plate portion, and a side plate portion coupling one end portion of the upper plate portion and one end portion of the bottom plate portion, the one end portions being located at one car longitudinal direction side, the two cross beams each formed to have a C-shaped section that is open toward the other car longitudinal direction side; and the attaching beam member includes a first coupling portion coupled to an upper surface of the bottom plate portion of one out of the two cross beams and a second coupling portion coupled to an outer surface of the side plate portion of the other cross beam.

6. A railcar comprising:

the attaching unit according to claim 4; and an underfloor device supported by the attaching unit.

7. The railcar according to claim 6, wherein:

the underfloor device includes an attaching arm including a horizontal portion; and the horizontal portion is fixed to an upper surface of the attaching metal fitting.

8. The attaching unit according to claim 4, wherein:

the second member includes a second fixing portion overlapping a side plate portion of the attaching beam member from a lateral side to be fixed to the side plate portion, the side plate portion being located at an upper side of the projecting portion;

the second supporting portion extends from a lower end of the second fixing portion; and the second member is formed to have an L-shaped section.

9. An attaching unit provided between at least two cross beams extending in a car width direction, an underfloor device being attachable to the attaching unit through an attaching metal fitting, the attaching unit comprising:

an attaching beam member arranged between the two cross beams and extending in a car longitudinal direction; and the attaching metal fitting fixed to the attaching beam member and used to attach the underfloor device to an underframe of a railcar, wherein:

the attaching beam member is configured to be provided at any car width direction position between the two cross beams; and the attaching metal fitting includes a fourth fixing portion overlapping the attaching beam member from a lateral side to be fixed to the attaching beam member and extending downward from the attaching beam member and a fourth supporting portion extending in a horizontal direction from a lower end portion of the fourth fixing portion to be located under the attaching beam member.

10. An attaching metal fitting used to attach an underfloor device to an underframe of a railcar including a beam member, the attaching metal fitting comprising:

a first member located at a lower side of a projecting portion projecting in a horizontal direction at a lower end portion of the beam member and formed integrally with or separately from the beam member; and a second member located at an upper side of the projecting portion, wherein:

the first member includes a first supporting portion overlapping the projecting portion from below to be fixed to the projecting portion;

the second member includes a second supporting portion overlapping the projecting portion from above to be fixed to the projecting portion; and an upper surface of the second supporting portion supports the underfloor device with the projecting portion sandwiched between the first supporting portion and the second supporting portion; wherein:

the second member includes a second fixing portion in addition to the second supporting portion;

the second fixing portion overlaps a side plate portion of the beam member from a lateral side to be fixed to the side plate portion, the side plate portion being located at an upper side of the projecting portion;

the second supporting portion extends from a lower end of the second fixing portion; and the second member is formed to have an L-shaped section.

* * * * *